US009879417B2

(12) United States Patent
Shu

(10) Patent No.: US 9,879,417 B2
(45) Date of Patent: Jan. 30, 2018

(54) RIGIDITY-CONTROLLABLE SEISMIC-ISOLATION SUPPORT UTILIZING GRAVITATIONAL NEGATIVE RIGIDITY

(71) Applicant: Architectural Design & Research Institute of South China University of Technology, Guangzhou, Guangdong Province (CN)

(72) Inventor: Xuanwu Shu, Guangzhou (CN)

(73) Assignee: ARCHITECTURAL DESIGN & RESEARCH INSITUTE OF SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 15/306,449

(22) PCT Filed: Aug. 12, 2014

(86) PCT No.: PCT/CN2014/084193
§ 371 (c)(1),
(2) Date: Oct. 24, 2016

(87) PCT Pub. No.: WO2015/161587
PCT Pub. Date: Oct. 29, 2015

(65) Prior Publication Data

US 2017/0044763 A1 Feb. 16, 2017

(30) Foreign Application Priority Data

Apr. 23, 2014 (CN) ..... 2014 1 0166593

(51) Int. Cl.
*E04B 1/98* (2006.01)
*E04H 9/02* (2006.01)

(52) U.S. Cl.
CPC ..... *E04B 1/985* (2013.01); *E04H 9/02* (2013.01); *E04H 9/021* (2013.01); *E04H 9/024* (2013.01)

(58) Field of Classification Search
CPC ..... E04B 1/985; E04B 1/98; E04H 9/02
See application file for complete search history.

(56) References Cited

U.S. PATENT DOCUMENTS

2012/0174500 A1* 7/2012 Yakoub ..... E04H 9/023 52/167.4
2017/0044789 A1* 2/2017 Shu ..... E02D 27/34

FOREIGN PATENT DOCUMENTS

CN 101624847 A * 1/2010
CN 201420308 Y * 3/2010
(Continued)

OTHER PUBLICATIONS

English Translation of the Written Opinion for PCT/CN2014/084193 dated Sep. 2, 2016 (7 pages).*

*Primary Examiner* — Rodney Mintz
(74) *Attorney, Agent, or Firm* — Hoffmann & Baron, LLP

(57) ABSTRACT

A stiffness-controllable earthquake-isolation support using negative gravity stiffness, which comprises an upper plate connected to an upper structure, a lower plate connected to a base structure at the bottom, K supporting columns arranged longitudinally between the upper and lower plates, with the supporting columns respectively connected with the upper and lower plates through a ball hinge, and L elastic connecting plates arranged laterally between the supporting columns, wherein K≥3, L≥N×K and N≥1. The earthquake-isolation support, the supporting column and the ball hinges at both ends of the supporting column form, under the action of gravity of the upper structure, the negative gravity stiffness that causes the upper structure to deviate from the equilibrium position, and the frame structure restores the
(Continued)

upper structure to the equilibrium position, with the stiffness of the earthquake-isolation support adjustable.

4 Claims, 5 Drawing Sheets

(56) References Cited

FOREIGN PATENT DOCUMENTS

| | | | | |
|---|---|---|---|---|
| CN | 201567693 | U | * | 9/2010 |
| CN | 203451989 | U | * | 2/2014 |
| JP | 2002106635 | A | * | 4/2002 |

* cited by examiner

RIGIDITY-CONTROLLABLE SEISMIC-ISOLATION SUPPORT UTILIZING GRAVITATIONAL NEGATIVE RIGIDITY

FIELD OF THE INVENTION

The present invention relates to the field of structural earthquake and wind resistance, especially a stiffness-controllable earthquake-isolation support using negative gravity stiffness.

BACKGROUND OF THE INVENTION

It is already a mature technology to apply the earthquake-isolation technology to structural works to reduce the hazard of earthquake. Japan is earlier in research and application of this field. China also carried out application research of this field in recent two decades, and has built a number of earthquake-isolation buildings. The current Chinese seismic design specifications also include the earthquake-isolation design.

At present, the earthquake-isolation supports adopted in the earthquake-isolation structure at home and abroad are rubber supports.

The rubber supports are generally cylindrical, having the vertical bearing capacity of $$N = Af = \frac{\pi D^2}{4} f,$$

wherein A is the horizontal area of the rubber of the support, f is the compressive strength of the rubber, and D is the diameter of the support. The horizontal stiffness of the cylindrical rubber support is approximately $$K = \frac{12EJ}{h^3},$$

wherein E is the elastic modulus of the rubber, $$J = \frac{\pi D^4}{64}$$

is the moment of inertia of the horizontal section of the rubber, and h is the total thickness of the rubber of the support, thus $$K = \frac{3\pi E D^4}{16h^3}.$$

In this way, the relationship between the horizontal stiffness K and the vertical bearing capacity N of the cylindrical rubber support is $$K = \frac{3E}{4f} \times \frac{D^2}{h^3} N.$$

E and f are constants, h cannot be too big, D cannot be too small, thus the horizontal stiffness of the rubber earthquake-isolation support cannot be too small, and therefore there is still a large part of the seismic energy transmitted through the rubber earthquake-isolation support to the upper structure.

For the structural earthquake isolation, the smaller the horizontal stiffness and damping of the earthquake-isolation support, the better the earthquake-isolation results will be. However, if the horizontal stiffness of the earthquake-isolation support is zero, the earthquake-isolation support will not have a restoring force after the earthquake, and the upper structure will not be restored to the original state; therefore, the earthquake-isolation support still needs a certain level of stiffness.

Thus, an ideal earthquake-isolation support has larger vertical bearing capacity, controllable horizontal stiffness, sufficient bearing capacity of resistance to lateral displacement, and smaller damping.

Contents of the Invention

A purpose of the present invention is to overcome the above defects of the prior art, and provide a stiffness-controllable earthquake-isolation support using negative gravity stiffness.

The purpose of the present invention is achieved through the following technical solution:

1. A stiffness-controllable earthquake-isolation support using negative gravity stiffness is provided, comprising an upper plate connected to an upper structure, a lower plate connected to a base structure at the bottom, K supporting columns arranged longitudinally between the upper and lower plates, with the supporting columns respectively connected with the upper and lower plates through a ball hinge, and L elastic connecting plates arranged laterally between the supporting columns, wherein $K \geq 3$, $L \geq N \times K$ and $N \geq 1$.

The supporting columns are respectively connected with the upper and lower plates through a ball hinge; specifically, the supporting columns are provided at both ends with a concave spherical surface, and the upper and lower plates are provided in the connection position with a corresponding convex spherical surface; alternatively, the supporting columns are provided at both ends with a convex spherical surface, and the upper and lower plates are provided in the connection position with a corresponding concave spherical surface. Preferably, the supporting columns are provided at both ends with a concave spherical surface; when the supporting columns are provided at both ends with a convex spherical surface, with the height of the earthquake-isolation layer constant, the distance between centers of the spheres becomes smaller, and performance of the earthquake-isolation layer deteriorates.

The connecting plate is of a folding type. The folding-type connecting plate can reduce the bending stiffness of the connecting plate, thus improving the bending bearing capacity of the connecting plate, thereby improving the bearing capacity of resistance to lateral displacement of the earthquake-isolation support.

The ball hinge is coated at the contact surface with a lubricant or polytetrafluoroethylene, so as to reduce the frictional force at the frictional rotating portion.

The upper plate, the lower plate and the supporting column are all made of high-strength metal materials, and the connecting plate is made of high-strength elastic materials.

The working principle of the present invention is as follows:

1. The no-damping circular frequency of the single-degree-of-freedom system with the stiffness of k and the mass of m is $$\omega = \sqrt{\frac{k}{m}}.$$

2. For the simple pendulum shown in FIG. 1, the role of its gravity is to restore a particle to the equilibrium position, and its equivalent stiffness is positive stiffness. The no-damping circular frequency of this simple pendulum under the action of gravity is $$\omega = \sqrt{\frac{g}{H}} = \sqrt{\frac{mg}{mH}} = \sqrt{\frac{mg/H}{m}},$$

and therefore the equivalent stiffness of this simple pendulum is $$k_b = \frac{mg}{H},$$

which can be called gravity stiffness.

3. The system shown in FIG. 2 is a common simple pendulum with the addition of a spring, wherein the role of the gravity and spring is to restore the particle to the equilibrium position, with both the gravity equivalent stiffness and the stiffness of the spring being positive stiffness. The no-damping circular frequency of this composite simple pendulum is $$\omega = \sqrt{\frac{g}{H} + \frac{k}{m}} = \sqrt{\frac{mg}{mH} + \frac{k}{m}} = \sqrt{\frac{mg/H + k}{m}},$$

and therefore the equivalent stiffness of this composite simple pendulum is $$k_d = \frac{mg}{H} + k.$$

4. In the system shown FIG. 3, the weight of the simple pendulum is put on the top, the acceleration of gravity is oriented from the particle to the shaft of the pendulum, and a spring is used to maintain stability of the particle. The role of gravity of this composite simple pendulum is to make the particle deviate from the equilibrium position, and the equivalent stiffness thereof $$k_b = -\frac{mg}{H}$$

is negative stiffness, which can be called negative gravity stiffness; the role of the spring is to restore the particle to the equilibrium position, with the stiffness thereof being positive stiffness. The no-damping circular frequency of this composite simple pendulum is $$\omega = \sqrt{\frac{k}{m} - \frac{g}{H}} = \sqrt{\frac{k - mg/H}{m}},$$

and therefore the equivalent stiffness of this composite simple pendulum is $$k_d = k - \frac{mg}{H};$$

obviously, when $$\frac{mg}{H}$$

is given, the equivalent stiffness of the system can be adjusted by adjusting the stiffness k of the spring, thus achieving the purpose of adjusting the circular frequency to be ω.

5. The system shown in FIG. 4 is evolved from the system shown in FIG. 3. The mass block of this composite system, due to the restricting role of a connecting rod, can only allow translation instead of rotation, and can allow neglection of the vertical motion, with only its horizontal motion studied. The role of gravity of this composite system is also to make the mass block deviate from the equilibrium position, and the equivalent stiffness thereof $$k_b = -\frac{mg}{H}$$

is also negative stiffness; the role of the spring is to restore the particle to the equilibrium position, with the stiffness thereof being positive stiffness; the no-damping circular frequency of this composite system is also $$\omega = \sqrt{\frac{k}{m} - \frac{g}{H}} = \sqrt{\frac{k - mg/H}{m}},$$

and therefore the equivalent stiffness of this composite system is also $$k_d = k - \frac{mg}{H}.$$

Likewise, when $$\frac{mg}{H}$$

is given, the equivalent stiffness of the system can be adjusted by adjusting the stiffness k of the spring, thus achieving the purpose of adjusting the circular frequency to be ω.

6. The system shown in FIG. 5 is evolved from the system shown in FIG. 4. After the horizontal spring is removed, a rigidly connected beam is added between the connecting rods, and the mass block can be restored to the equilibrium position by making use of the bending moment produced by the bending deformation of the beam, with the result thereof also equivalent to a horizontal spring. The no-damping circular frequency of this composite system can be likewise expressed as $$\omega = \sqrt{\frac{k_e}{m} - \frac{g}{H}} = \sqrt{\frac{k_e - mg/H}{m}},$$

and therefore the equivalent stiffness of this composite system is $$k_d = k_e - \frac{mg}{H},$$

wherein $k_e$ is the equivalent horizontal stiffness of the composite structure of the beam and the connecting rod. The equivalent stiffness of the system can be adjusted by adjusting the sectional dimension and quantity of the beam, thus achieving the purpose of adjusting the circular frequency ω. The stiffness-controllable earthquake-isolation support using negative gravity stiffness of the present invention has a mechanical model shown in FIG. 5; the equivalent stiffness of the system can be adjusted by adjusting the sectional dimension and quantity of the elastic connecting plate, thus achieving the purpose of adjusting the circular frequency ω.

The present invention has the following advantages and beneficial results compared with the prior art:

A. For the result of isolating earthquakes, the smaller the horizontal stiffness of the earthquake-isolation layer, the better the earthquake-isolation results of the layer will be. However, the horizontal stiffness of the traditional rubber earthquake-isolation support is related to its vertical bearing capacity, and therefore there is still a large part of the seismic energy transmitted through the rubber earthquake-isolation support to the upper structure. The earthquake-isolation support of the present invention, under the premise of ensuring the structural stability, can allow the horizontal stiffness to be designed very small, with the earthquake-isolation result much better than the rubber support.

B. There is an aging problem with the traditional rubber earthquake-isolation support, and therefore replacement of the support must be considered; with the earthquake-isolation support of the present invention made of metal materials, as long as anti-rust treatment (galvanizing treatment) is well made on the metal materials, the support will not fail.

C. The horizontal stiffness of the earthquake-isolation support of the present invention can be easily controlled: The stiffness of the earthquake-isolation layer can be controlled by making use of the negative gravity stiffness of the upper structure of the earthquake-isolation layer superimposed with the positive stiffness of the regulable earthquake-isolation layer. Specifically, in the earthquake-isolation layer, the upper structure is supported by a metal column with high bearing capacity, and a steel frame is formed by rigid connection of the spring connecting plate between the columns. To be different from the traditional column, the top and bottom of the column are connected through ball hinges rather than rigid connection. In this way, the so-called negative gravity stiffness with a value of $$k_b = -\frac{mg}{H}$$

is formed under the action of gravity. The steel frame formed by the column and the connecting plate has equivalent horizontal stiffness of $k_e$. The actual stiffness of the earthquake-isolation layer is $$k_d = k_e + k_b = k_e - \frac{mg}{H}.$$

The actual stiffness of the earthquake-isolation layer can be controlled to be $k_d$ by adjusting $k_e$.

D. Allowing to be used in conjunction with a stiffness control mechanism: Since both the horizontal stiffness and the vertical bearing capacity of the earthquake-isolation support of the present invention can be controlled, in cooperation with the stiffness control mechanism if necessary, the earthquake-isolation support of the present invention can not only well isolate earthquake, but also well resist wind.

Stiffness of the stiffness control mechanism is connected in parallel with stiffness of the earthquake-isolation support. In the normal non-seismic situation, the stiffness control mechanism has very high stiffness, and the wind load and other horizontal forces are transmitted to the base through the stiffness control mechanism; under the action of an earthquake, the acceleration of the ground motion triggers the action of the stiffness control mechanism, such that the horizontal stiffness of the stiffness control mechanism suddenly becomes zero, and the stiffness of the earthquake-isolation layer only includes the stiffness of the earthquake-isolation support, thus isolating the seismic energy effectively.

DETAILED DESCRIPTION OF THE EMBODIMENTS

Figure 1:
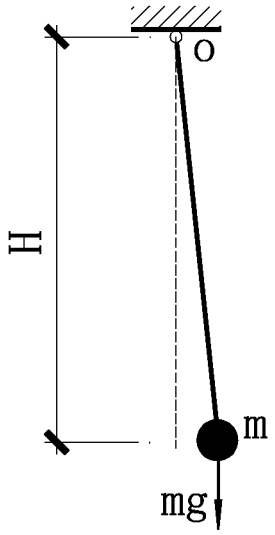
FIG. 1 is a schematic drawing of a model of a simple pendulum.
Figure 2:
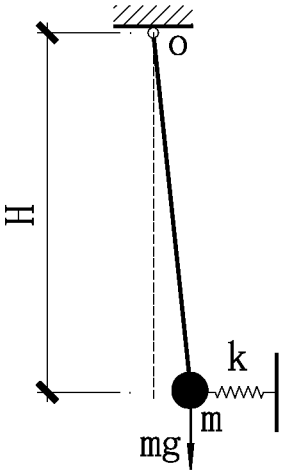
FIG. 2 is a schematic drawing of a model of a simple pendulum plus a spring.
Figure 3:
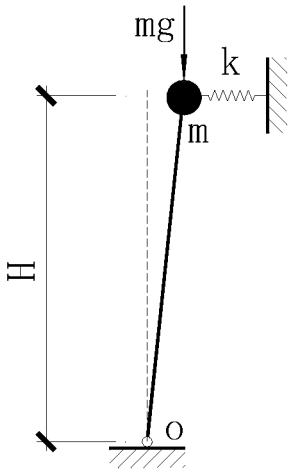
FIG. 3 is a schematic drawing of a model of a simple pendulum with negative gravity stiffness plus a spring.
Figure 4:
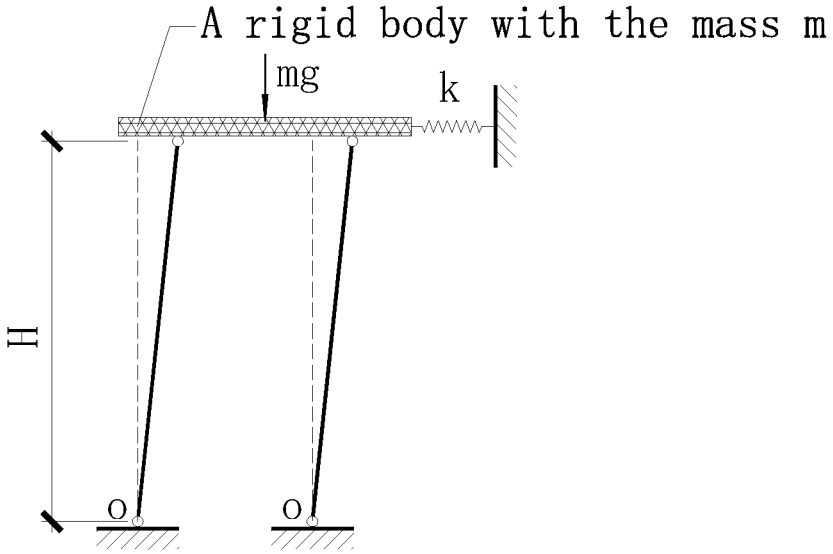
FIG. 4 is a schematic drawing of a model of double connecting rods with negative gravity stiffness plus a spring.
Figure 5:
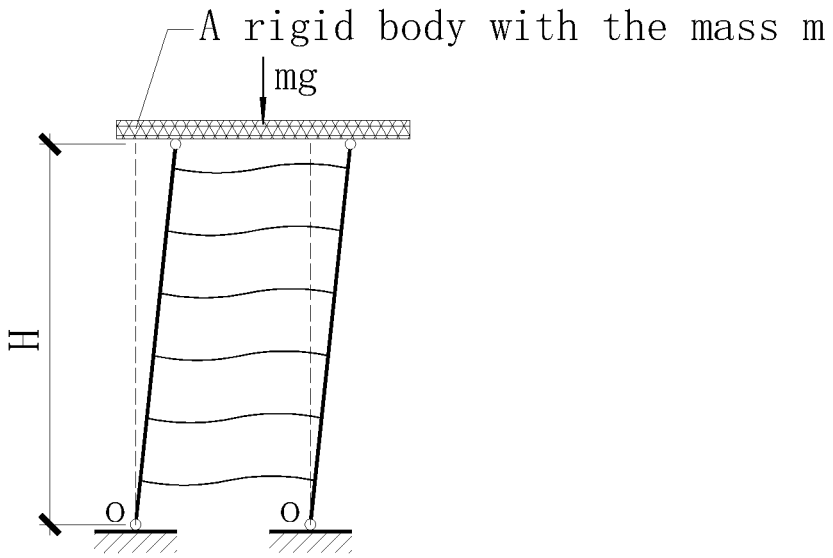
FIG. 5 is a schematic drawing of a model of double connecting rods with negative gravity stiffness plus an equivalent spring.

The present invention will be further described below in detail with reference to examples and drawings; however, the embodiments of the present invention are not limited thereto.

Example 1

As shown in FIGS. 6-9, a stiffness-controllable earthquake-isolation support using negative gravity stiffness is provided, comprising an upper plate 1 connected to an upper structure, a lower plate 2 connected to a base structure at the bottom, K supporting columns 3 arranged longitudinally between the upper plate 1 and the lower plate 2, with the supporting column 3 respectively connected with the upper plate 1 and the lower plate 2 through a ball hinge 4, and L elastic connecting plates 5 arranged laterally between the supporting columns 3, wherein K≥3, L≥N×K and N≥1;

the supporting column 3 is respectively connected with the upper plate 1 and the lower plate 2 through the ball hinge 4; specifically, the supporting column 3 is provided at both ends with a concave spherical surface, and the upper plate 1 and the lower plate 2 are provided in the connection position with a corresponding convex spherical surface;

the connecting plate 5 is of a folding type;

the ball hinge 4 is coated at the contact surface with a lubricant or polytetrafluoroethylene; and the upper plate 1, the lower plate 2 and the supporting column 3 are all made of high-strength metal materials, and the connecting plate 5 is made of high-strength elastic materials.

Figure 6:
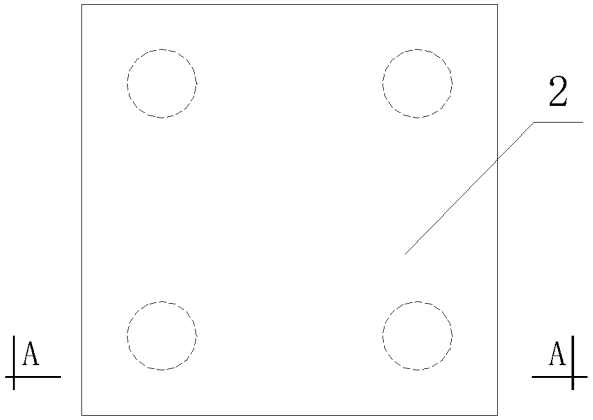
FIG. 6 is a bottom view of the stiffness-controllable earthquake-isolation support using negative gravity stiffness of the present invention.
Figure 7:
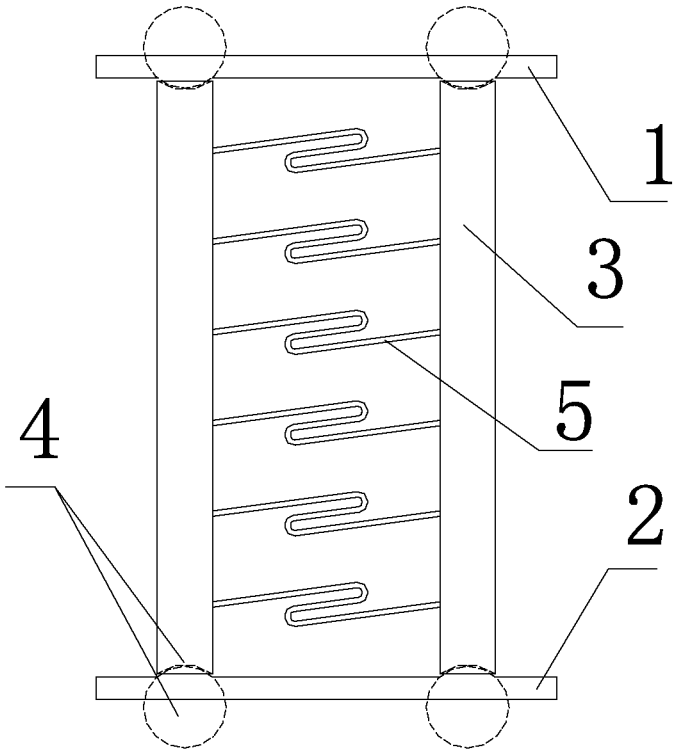
FIG. 7 is a cross-sectional view taken along Line A-A of the support in FIG. 6.
Figure 8:
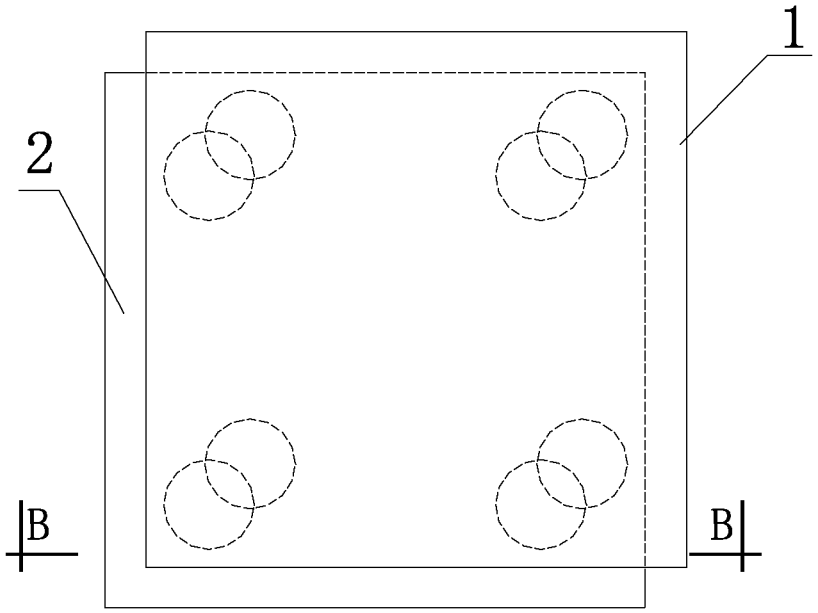
FIG. 8 is a top view of the stiffness-controllable earthquake-isolation support using negative gravity stiffness of the present invention.
Figure 9:
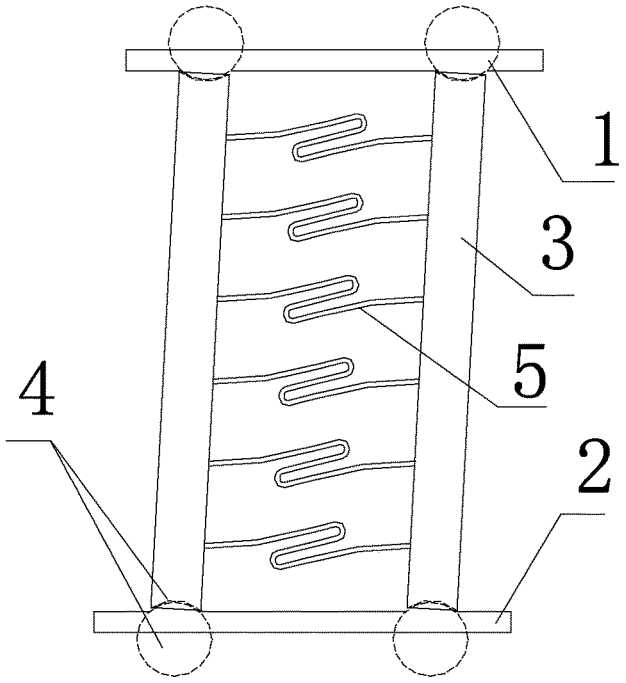
FIG. 9 is a cross-sectional view taken along Line B-B of the support in FIG. 8.

Specifically, there is no relative displacement between the upper plate 1 and the lower plate 2 in FIGS. 6 and 7; there is relative displacement between the upper plate 1 and the lower plate 2 in FIGS. 8 and 9, with the folding-type connecting plate bent and deformed.

There is no elastic connecting plate between adjacent columns, with the support columns only providing a vertical support force to the upper structure without a horizontal binding force. In this way, under the action of a vertical load, the structure is in an unstable equilibrium state. The upper structure will have horizontal displacement as long as there is a small horizontal interference force on it, then the support column will tilt, with a gravity load further aggravating the inclination, and then the upper structure will collapse. This is the so-called structural instability. In order to avoid the instability of the upper structure, it is necessary to rely on the frame formed by the columns and the elastic connecting plate between the adjacent columns to provide sufficient horizontal stiffness and horizontal bearing capacity. When the horizontal stiffness of the frame provides a restoring force greater than, equal to or less than the overturning force of a gravity load, the structure is in a stable, occasional balanced or unstable state. When the structure is in a stable state, the horizontal stiffness and horizontal bearing capacity of the structure can be controlled by adjusting the stiffness of the elastic connecting plate between the adjacent columns.

Example 2

Example 2 is the same as Example 1 except the following parts:

The supporting columns are provided at both ends with a convex spherical surface, and the upper and lower plates are provided in the connection position with a corresponding concave spherical surface.

Example 3

Figure 10:
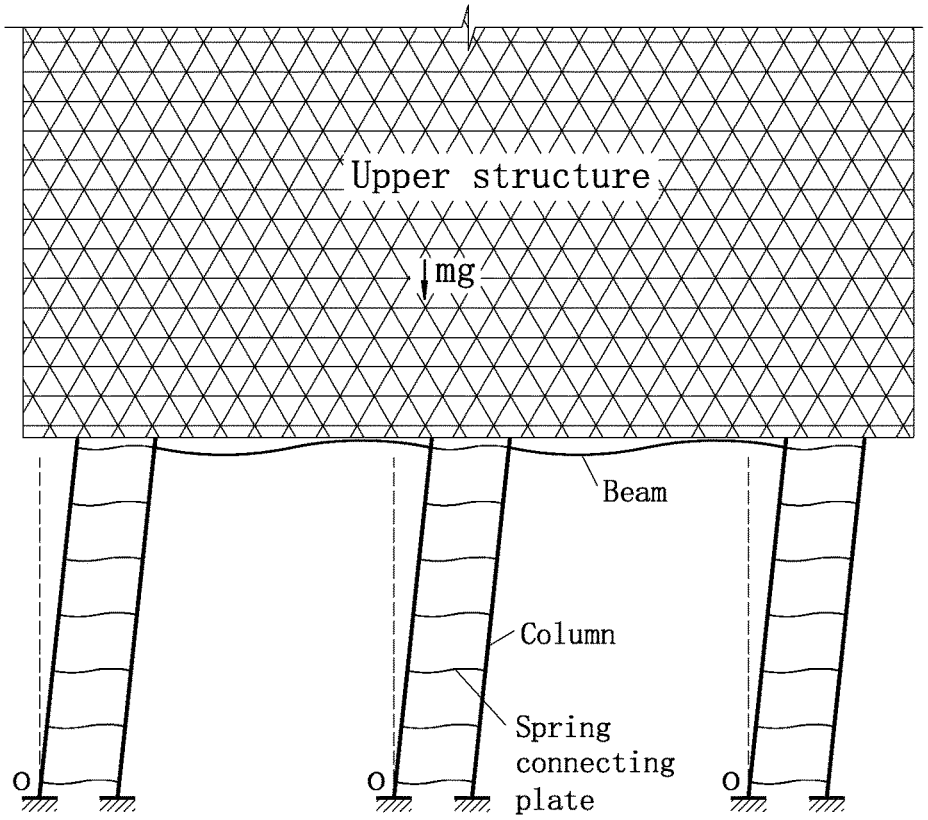
FIG. 10 shows a stiffness-controllable earthquake-isolation support without a ball hinge.

Example 3 is the same as Example 1 except the following parts:

As shown in FIG. 10, a earthquake-isolation support, whose vertical bearing capacity is not high, does not need to use a ball hinge; in the earthquake-isolation layer, a single-layer frame, whose lateral stiffness is not large, is made of materials with high bearing capacity. Considering the geometric nonlinearity of this frame, the gravity of the upper structure will also form the negative gravity stiffness. The purpose of controlling the actual stiffness of the earthquake-isolation layer can also be achieved by adjusting the stiffness of the frame itself. The spring connecting plate of the earthquake-isolation support can also be manufactured in a folded shape to improve the earthquake-isolation performance of the support.

The examples as described above are the preferred embodiments of the present invention. However, the embodiments of the present invention are not restricted to the examples as described above. Any other modification, polish, substitution, combination and simplification, so long as not departing from spiritual substance of the present invention, should be equivalent displacement, and fall within the extent of protection of the present invention.

What is claimed is:

1. A stiffness-controllable earthquake-isolation support having an equilibrium position, the support comprising:

an upper plate connected to an upper structure, wherein the upper structure has a gravity center, a lower plate comprising a bottom connected to a base structure at the bottom, K supporting columns arranged longitudinally between the upper and lower plates, with the supporting columns respectively connected with the upper and lower plates through a ball hinge, wherein one of (a) the K supporting columns are provided at both ends with a concave spherical surface, and the upper and lower plates are provided in a connection position with a corresponding convex spherical surface or (b) the K supporting columns are provided at both ends with a convex spherical surface, and the upper and lower plates are provided in the connection position with a corresponding concave spherical surface, and L elastic connecting plates arranged laterally between the supporting columns, wherein K≥3, L≥N×K and N≥1, wherein, when gravity causes the upper structure to deviate from the equilibrium position, the L elastic connecting plates restore the upper structure to the equilibrium position, wherein the support uses negative gravity stiffness whereby gravity makes the support deviate from the equilibrium position, wherein during vibration, the support has lateral sway, and wherein the gravity center of the upper structure supported on the support decreases with an inclination of the support.

2. The stiffness-controllable earthquake-isolation support according to claim 1, wherein the connecting plate is foldable.

3. The stiffness-controllable earthquake-isolation support according to claim 1, wherein the ball hinge is coated at a contact surface with a lubricant or polytetrafluoroethylene.

4. The stiffness-controllable earthquake-isolation support according to claim 1, wherein the upper plate, the lower plate and the supporting column are all made of high-strength metal materials, and the connecting plate is made of high-strength elastic materials.

* * * * *